US010906334B2

(12) United States Patent
Kedar

(10) Patent No.: US 10,906,334 B2
(45) Date of Patent: Feb. 2, 2021

(54) WRINKLE DETECTOR FOR A FABRIC PRINTER

(71) Applicant: Kornit Digital Ltd., Rosh HaAyin (IL)

(72) Inventor: Eli Kedar, Beit-Dagan (IL)

(73) Assignee: Kornit Digital Ltd., Rosh HaAyin (IL)

( * ) Notice: Subject to any disclaimer, the term of this patent is extended or adjusted under 35 U.S.C. 154(b) by 0 days.

(21) Appl. No.: 16/322,132

(22) PCT Filed: Aug. 2, 2017

(86) PCT No.: PCT/IL2017/050856
§ 371 (c)(1),
(2) Date: Jan. 31, 2019

(87) PCT Pub. No.: WO2018/025268
PCT Pub. Date: Feb. 8, 2018

(65) Prior Publication Data

US 2020/0122489 A1 Apr. 23, 2020

Related U.S. Application Data

(60) Provisional application No. 62/369,840, filed on Aug. 2, 2016.

(51) Int. Cl.
*B41J 3/407* (2006.01)
*B41J 11/00* (2006.01)

(52) U.S. Cl.
CPC ..... *B41J 11/005* (2013.01); *B41J 3/4078* (2013.01); *B41J 11/0005* (2013.01)

(58) Field of Classification Search
CPC ..... B41J 11/005; B41J 3/4078; B41J 29/38; B41J 29/387
See application file for complete search history.

(56) References Cited

U.S. PATENT DOCUMENTS 5,521,692 A 5/1996 Bares
6,827,414 B2 12/2004 Iwatsuki et al.
(Continued)

FOREIGN PATENT DOCUMENTS

CN 101184626 5/2008
CN 103386813 11/2013
(Continued)

OTHER PUBLICATIONS

Notification of Office Action and Search Report dated Mar. 3, 2020 From the China National Intellectual Property Administration Re. Application No. 201780052698.3 and Its Translation of Office Action Into English. (16 Pages).
(Continued)

*Primary Examiner* — Scott A Richmond

(57) ABSTRACT

A wrinkle detector for detecting creases or wrinkles to protect a print head of a fabric printer from occlusion by protruding fabric. The wrinkle detector comprises a mounting located in advance of a print head relative to fabric approaching to be printed, the mounting comprising one or more deflectable elements extending into a predetermined clearance zone between the printing head and the fabric, wherein deflection of the elements is used as an indicator of fabric protruding into the clearance zone. The detector may be used to halt or modify printing, in particular ink jet printing of the fabrics so that occlusion does not block the printing nozzles.

22 Claims, 13 Drawing Sheets

(56) References Cited

U.S. PATENT DOCUMENTS

| | | | | |
|---|---|---|---|---|
| 7,708,483 | B2 | 5/2010 | Samii et al. | |
| 8,307,765 | B2 | 11/2012 | Orlandi et al. | |
| 8,465,143 | B1 * | 6/2013 | Marino | B41J 3/4078 101/41 |
| 2002/0181963 | A1 * | 12/2002 | Takeda | B65H 7/02 399/45 |
| 2005/0151773 | A1 * | 7/2005 | Watarai | B41J 11/20 347/16 |
| 2009/0289990 | A1 * | 11/2009 | Kayanaka | B41J 11/06 347/32 |
| 2009/0303276 | A1 | 12/2009 | Van De Wynckel et al. | |
| 2010/0220130 | A1 | 9/2010 | Bruno et al. | |
| 2015/0124034 | A1 | 5/2015 | Shinoda et al. | |
| 2015/0239698 | A1 * | 8/2015 | Herrmann | B65H 23/032 242/419.5 |

FOREIGN PATENT DOCUMENTS

| | | |
|---|---|---|
| EP | 2915677 | 9/2015 |
| JP | 5346637 | 11/2013 |
| WO | WO 2018/025268 | 2/2018 |

OTHER PUBLICATIONS

International Preliminary Report on Patentability dated Feb. 14, 2019 From the International Bureau of WIPO Re. Application No. PCT/IL2017/050856. (7 Pages).

International Search Report and the Written Opinion dated Nov. 20, 2017 From the International Searching Authority Re. Application No. PCT/IL2017/050856. (10 Pages).

Supplementary European Search Report and the European Search Opinion dated Apr. 6, 2020 From the European Patent Office Re. Application No. 17836524.3.

Notification of Office Action and Search Report dated Oct. 26, 2020 From the China National Intellectual Property Administration Re. Application No. 201780052698.3 and Its English Summary of Office Action Into English. (15 Pages).

* cited by examiner

WRINKLE DETECTOR FOR A FABRIC PRINTER

RELATED APPLICATIONS

This application is a National Phase of PCT Patent Application No. PCT/IL2017/050856 having International filing date of Aug. 2, 2017, which claims the benefit of priority under 35 USC § 119(e) of U.S. Provisional Patent Application No. 62/369,840 filed on Aug. 2, 2016. The contents of the above applications are all incorporated by reference as if fully set forth herein in their entirety.

FIELD AND BACKGROUND OF THE INVENTION

The present invention, in some embodiments thereof, relates to a wrinkle detector for a printer and, more particularly, but not exclusively, to a crease or wrinkle detector for a fabric or textile printing machine that uses inkjet printing.

Digital fabric printing may use inkjet-based techniques that involve a print head and nozzles. Such techniques may be applied both to rolls of fabric and to garments which need to be placed on a platen. The rolls of fabric typically move rapidly past a printing head to be printed. The printing head may itself be static. The garments are generally placed on a platen which remains generally stationary as a printing head moves around over the garment to carry out the printing.

In general, throughput is important. A printing schedule may require a certain number of rolls of fabric to be printed per hour or there may be a queue of platens with garments that are passing through the various stations of the printer.

In order to obtain a good quality result it is necessary that the ink jet nozzles are close to the fabric. However there is a problem that fabric can have wrinkles or creases which can cause the fabric at the location of the wrinkle to occlude or even touch the print head and thus halt the jet. The issue is not restricted to actual printing inks. In fabric printing there are also pre-printing materials that are sprayed on the fabric. The spray substances, whether inks or pre-treatment substances, may be rendered unable to leave the nozzles and may thus dry in the nozzle, causing a blockage. If enough nozzles are blocked the print head may have to be replaced which not only is a significant cost, but also causes significant delays, seriously upsetting the printing schedule.

Imaging is used in the art to detect creases and wrinkles. However imaging based detection is sensitive to the color of the fabric and does not work particularly well for dark colored fabrics or for fabrics which already have high contrast printing on them such as black stripes on white.

In order to solve the above problem, it is known to use a light beam parallel to the top of the garment. The beam may detect an obstacle such as a wrinkle that disrupts a printing operation to be performed on a printing surface of a printing portion of a workpiece by a printing head of an ink-jet printer.

Problems with the above solution are that the printing environment includes clouds of small particles which both inhibit the beam and also tend to coat the beam source and detector.

SUMMARY OF THE INVENTION

The present embodiments may use a mechanical wrinkle detector located in front of the print head to mechanically detect those wrinkles likely to interfere with the print head.

Other embodiments may use side illumination to enhance contrast of the wrinkle and allow imaging to detect the wrinkle.

According to an aspect of some embodiments of the present invention there is provided a wrinkle detector for detecting creases or wrinkles to protect a print head of a fabric printer from occlusion by protruding fabric, the wrinkle detector comprising a mounting located in advance of a print head relative to fabric approaching to be printed, the mounting comprising at least one deflectable element extending into a predetermined clearance zone between the printing head and the fabric, wherein deflection of the at least one deflectable element is used as an indicator of fabric protruding into the clearance zone.

In an embodiment, the deflectable element is configured to cause electrical switching when deflected.

In an embodiment, the deflectable element is sufficiently light to be deflected by a light fabric.

In an embodiment, the deflectable element comprises a flap.

In an embodiment, the flap is configured to close a circuit upon deflection.

In an embodiment, the flap is configured to modulate a resistance or a reactance upon deflection.

In an embodiment, the deflectable element comprises a pin.

In an embodiment, the pin is an acupuncture-like needle.

In an embodiment, the pin is surrounded by a conductive ring and wherein deflection of the pin causes the pin and the ring to touch.

An embodiment may be configured to stop printing of a current printing job on detection of a wrinkle.

An embodiment may suffer a delay between making a detection due to a wrinkle and providing an output signal to the fabric printer, and the delay may be of the order of two milliseconds or may not exceed two milliseconds.

The clearance zone may be of the order of, or may not exceed, two millimeters.

In an embodiment, the clearance zone does not exceed one millimeter.

In an embodiment, a plurality of deflectable elements may form a comb structure wherein teeth of the comb extend into the clearance range in advance of the print head as the print head moves relative to fabric to be printed.

According to another aspect of the present invention a fabric printer comprising a print head for printing on fabrics may incorporate the wrinkle detector as discussed herein.

The printer may have a plurality of platens, each platen carrying an item to be printed, the fabric printer configured with a log unit to log items on which wrinkles are detected.

According to a further aspect of the present invention there is provided a method of protected printing of fabrics using a printhead, the method comprising:

defining a clearance zone below the print head;

feeding smoothed out fabric towards the print head for printing;

detecting wrinkles that extend into the clearance zone in fabric approaching the print head, the detecting comprising deflecting a deflectable element; and using the detecting to modify a printing operation.

The method may comprise providing a plurality of print jobs and wherein the modification comprises inhibiting printing on any one of the plurality of print jobs on which a wrinkle is detected while continuing to print each other print job.

According to a yet further aspect of the present invention there is provided a wrinkle detector for detecting creases or wrinkles to protect a print head of a fabric printer from occlusion by protruding fabric, the wrinkle detector comprising:

a light source located in advance of a print head relative to fabric approaching to be printed, the light source being located to shine light along a plane of a surface to be printed of the fabric, thereby to highlight wrinkles by enhancing brightness of a face of a wrinkle towards the light source and casting a shadow on a face of a wrinkle away from the light; and an imaging detector being located above the plane to detect wrinkles using the highlighting.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
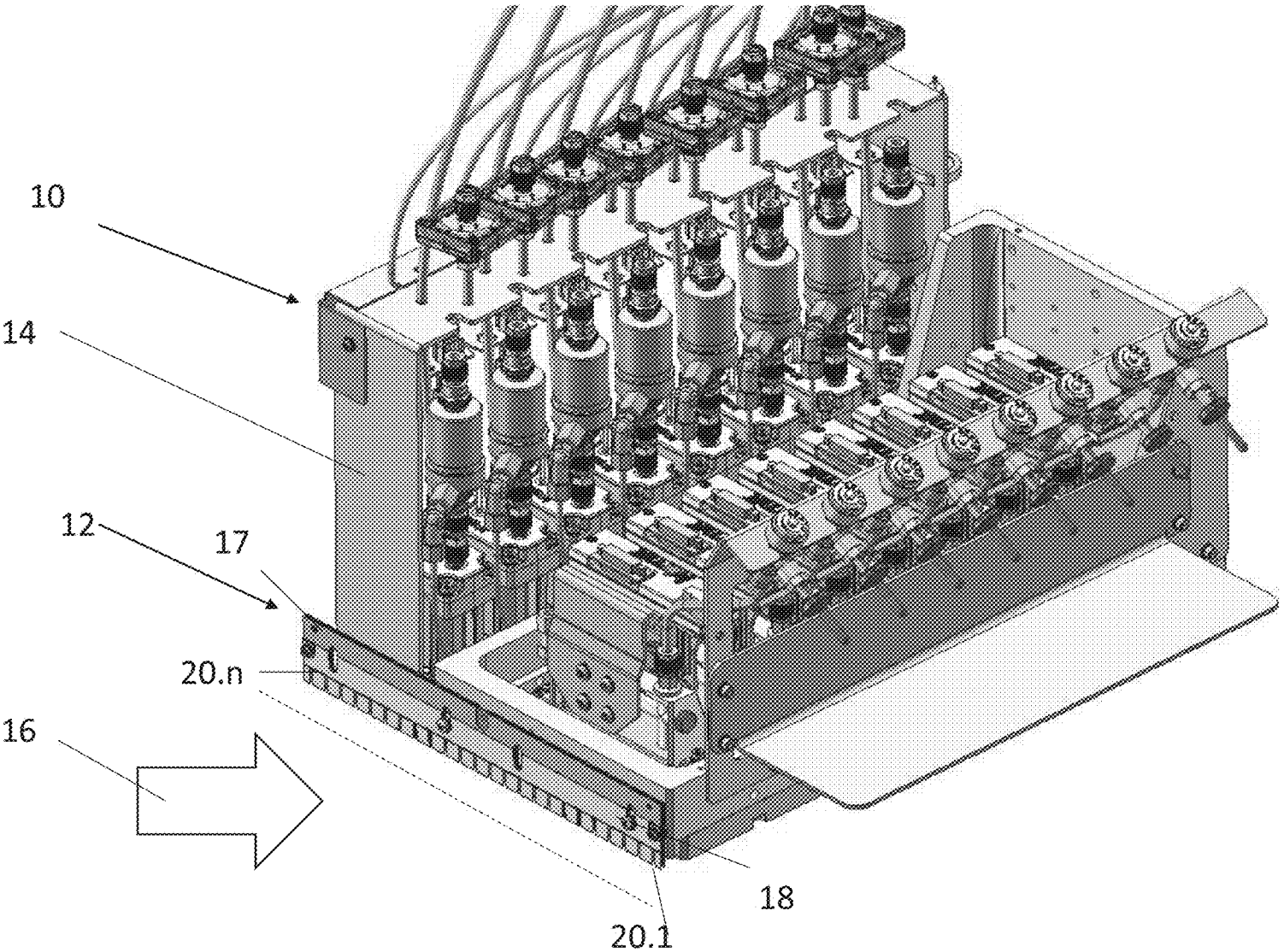
FIG. 1 is a simplified drawing of a print head for an ink jet fabric printer, with a wrinkle detector mounted in advance thereof in accordance with an embodiment of the present invention.

The present invention, in some embodiments thereof, relates to a fabric wrinkle detector and, more particularly, but not exclusively, to a wrinkle detector for a fabric printing machine.

The terms "wrinkle", "crease" and "fold" are used hereinafter interchangeably.

The terms "fabric", "textile", "textile fabric", are used hereinafter interchangeably. The term "textile" refers to a woven fabric whereas the term "fabric" is intended to cover both the woven and unwoven cases.

The present embodiments may detect protrusions in the fabric due to creases and wrinkles, irrespective of the color or contrast on the fabric. Detection may be used to find the creases and wrinkles as the print head approaches and thereby halt the printing process irrespective of the color of the fabrics and irrespective of clouds of particles in the environment. In the case of garments on a platen, a mechanical detector for example a detector made of electromechanical switches or of components that operate microswitches, detects any wrinkles so that the printing of the current platen is aborted to avoid risk to the print heads but continues as normal with the next platen in the queue.

Embodiments of the wrinkle detector may comprise a mounting located in advance of a print head relative to fabric approaching to be printed, the mounting comprising one or more deflectable elements extending into a predetermined clearance zone between the printing head and the fabric, wherein deflection of the elements is used as an indicator of fabric protruding into the clearance zone. The detector may be used to halt or modify printing, in particular ink jet printing of the fabrics so that occlusion does not block the printing nozzles.

A further embodiment may illuminate the wrinkle from the side, causing high contrast between an illuminated and a shadow side of the wrinkle which can then be detected by imaging from above at right angles to the light source.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 illustrates a simplified schematic diagram of an ink jet print head 10 equipped with a wrinkle or crease detector 12 according to embodiments of the present invention. The wrinkle detector may serve to protect the print head 10, and particularly the downwardly facing inkjet nozzles of the fabric printer from occlusion by protruding fabric. If the nozzles are occluded so that ink cannot spray out from the nozzles, then the ink tends to remain in the nozzles, and tends to dry and thus block the nozzle. A print head with more than a very small number of blocked nozzles fails to print correctly, requiring premature replacement of the print head which in turn leads to unnecessary costs and causes delays in printing. Thus in order to prevent occlusion, a wrinkle detector 12 is placed in advance of the print head on the side 14 facing the advancing fabric. Arrow 16 indicates the approaching fabric, although in some cases the fabric is static and the head moves, and in other cases the fabric moves and the head is static.

The wrinkle detector comprises a base 17, and a mounting 18, which are located in advance of the print head relative to fabric approaching to be printed, as discussed. The mounting comprises one or more deflectable elements which extend downwardly below the openings of the nozzles into a predetermined clearance zone between the printing head and the fabric. Any fabric that gets into that clearance zone is considered as dangerously close to the nozzles and causes deflection of one of the deflectable elements 20.1 . . . **20.*n***.

Deflection of any of the deflectable elements is used as an indicator of fabric protruding into the clearance zone. Movement of one or more of the elements indicates that the print head is in imminent danger of occlusion and the likelihood of blockage and some kind of avoidance action is required. One kind of avoidance action is to inhibit printing until the wrinkle has passed or for the duration of a current print job. Another possibility is to temporarily increase the distance between the print head and the fabric.

As discussed herein, the height of the crease that becomes problematic for the nozzles is the 1-2 mm range of the clearance zone in a typical embodiment.

The deflectable elements 20.1 . . . **20.*n*** may cause electrical switching when deflected to set up a signal which can then be used to modify printing.

Fabrics can be very light and the deflectable elements may be sufficiently light to be deflected by a small crease or wrinkle from the lightest of fabrics. Furthermore the elements need to return to their original positions rapidly after detection of a wrinkle so that they are in position to detect the next wrinkle. Generally the relative speed between the fabric and the print head is of the order of a 1000 mm per second so that even a few milliseconds of reaction time leaves the fabric unprotected.

As shown in FIGS. 1-5, the deflectable elements are flaps 20.1 . . . **20.*n***, and a series of flaps fill out a comb structure that extends over the length of the front of the printing head. Due to the need to react rapidly to very small light wrinkles on even the lightest of fabrics, the flaps are very sensitive and may bend to close a circuit upon deflection. Alternatively the circuit may be continually closed and the effect of the flaps may be to modulate a resistance or a reactance upon deflection.

Figure 2:
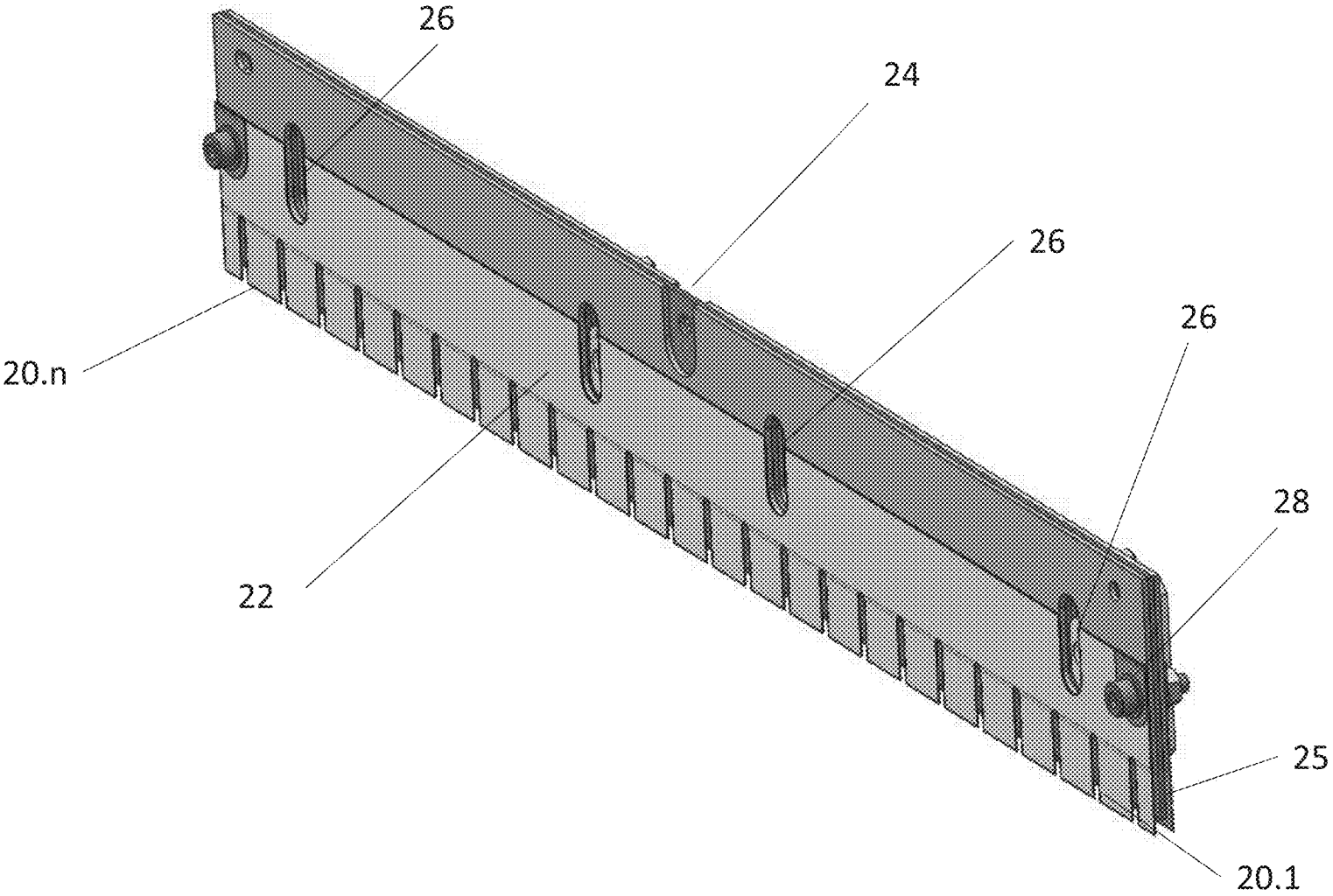
FIG. 2 is a simplified schematic diagram showing a wrinkle detector according to an embodiment of the present invention.
Figure 3:
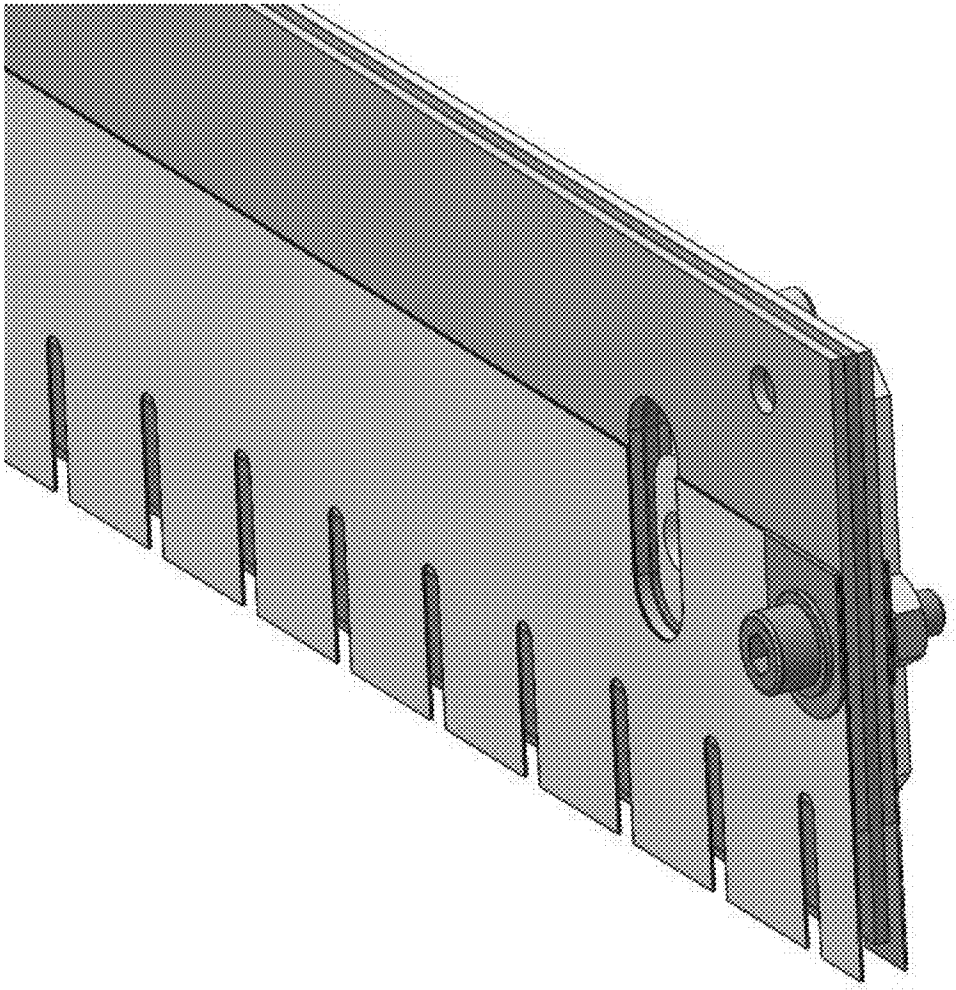
FIG. 3 is a detail of the embodiment of FIG. 2.
Figure 4:
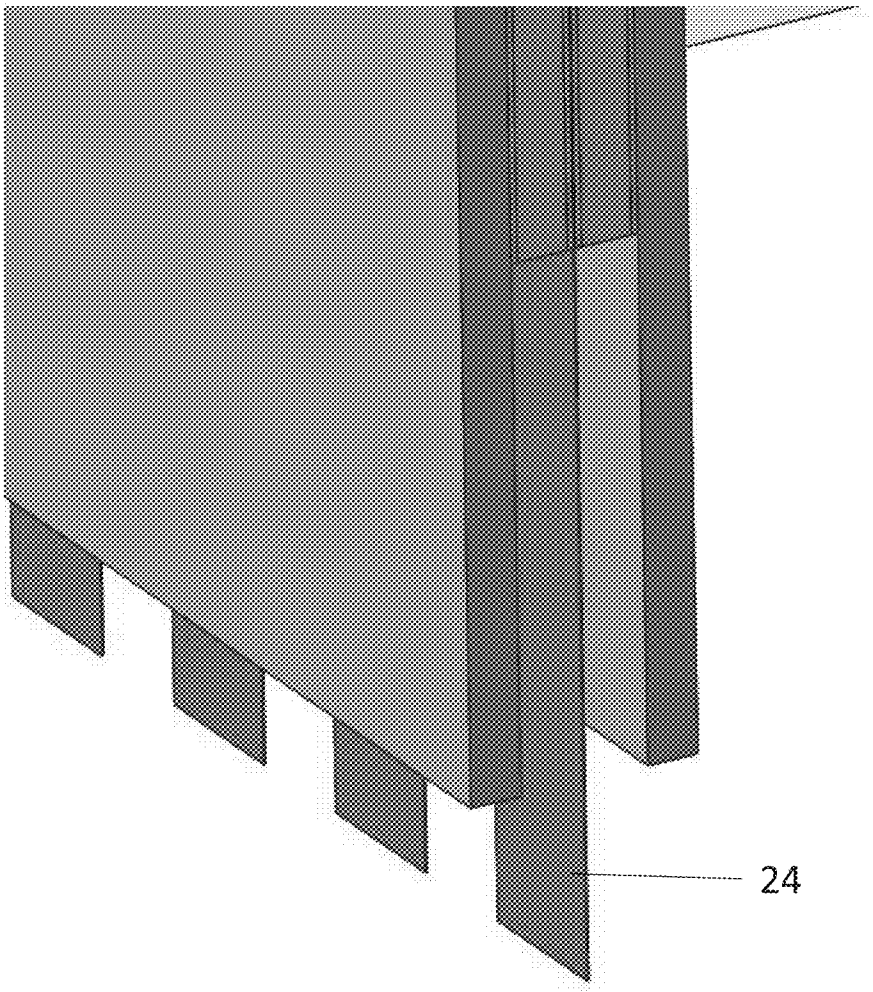
FIG. 4 is a further detail of the embodiment of FIG. 2.

The comb structure may be layered as schematically shown in FIG. 2. Layer 22 is an isolated conductive layer, and layer 24 is a conductive layer. Layer 25 is a conductive layer which could in some embodiments is a conductive glue layer. In operation, a wrinkle pushes a flap of layer 22 onto the corresponding flap of layer 24, closing a circuit and causing a signal. Location holes 26 allow for the layers to be correctly aligned during construction. Layer 28 is a forward glue layer. FIG. 2 shows the comb structure mounting with the flaps. FIGS. 3 and 4 show details of FIG. 2.

Figure 5:
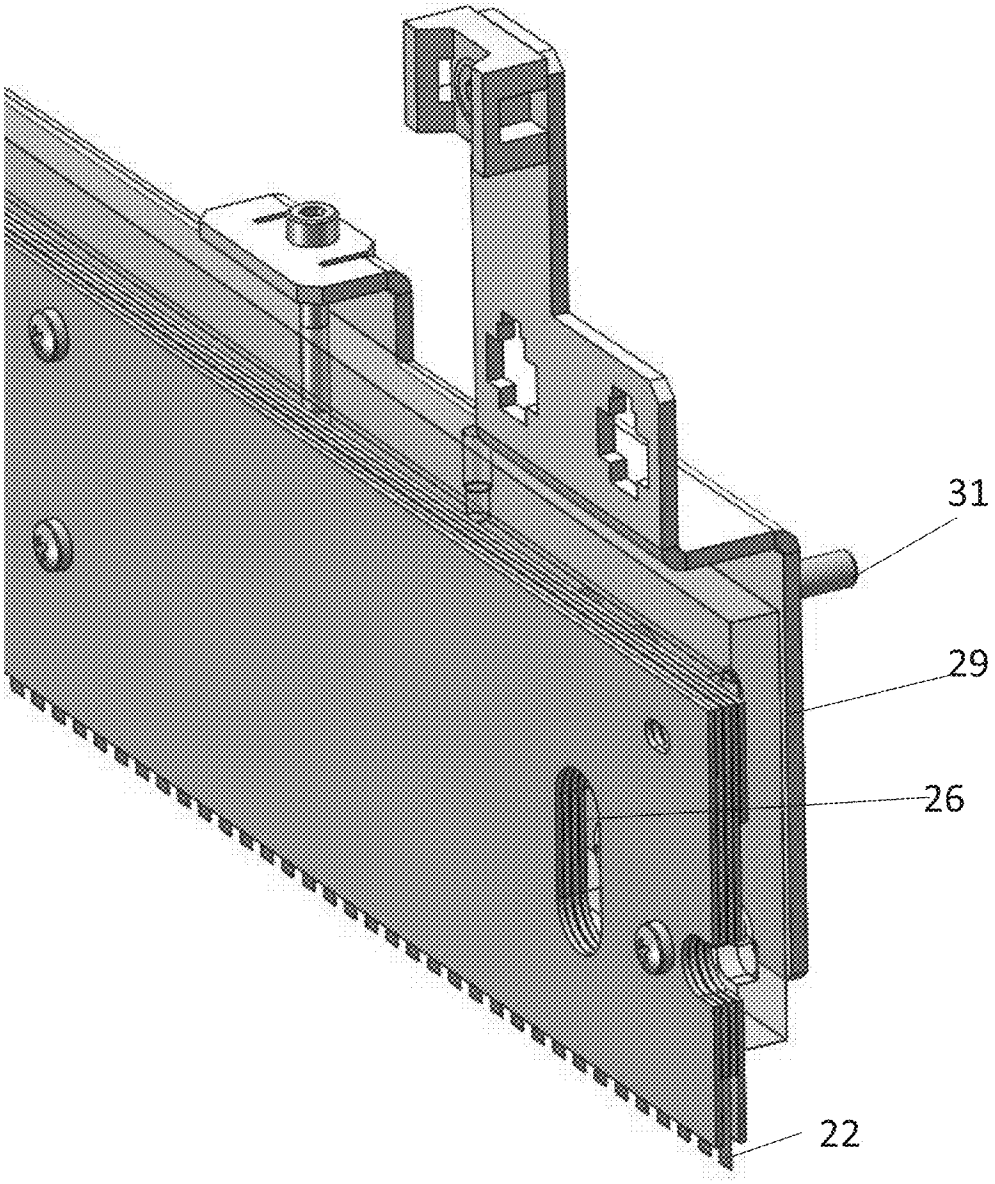
FIG. 5 is a simplified schematic diagram that shows the detector of FIG. 2 mounted on a base.
Figure 6:
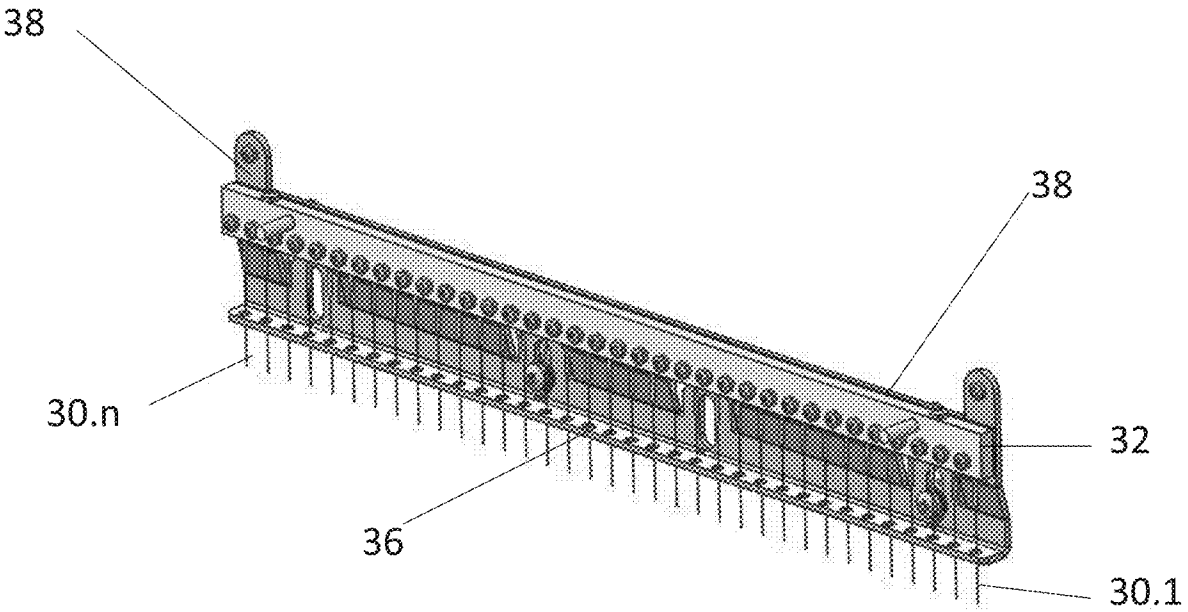
FIG. 6 is a simplified diagram of another embodiment of a wrinkle detector according to the present invention.

FIG. 5 shows the comb structure mounted to a base 29. Spacers 31 provide a separation between the detector and the print head so that the detector finds the creases sufficiently in advance to provide a signal in time to save the print head from damage.

FIGS. 6-10 illustrate an alternative embodiment of the present invention in which the deflectable elements are pins or needles 30.0 . . . **30.*n*. Again the pins may detect wrinkles in the lightest of fabrics and may reset themselves in the timescale of milliseconds. One kind of needle that is extremely light and sufficiently springy is the acupuncture needle, and like needles of similar dimensions, and in one embodiment the detector consists of a mount 32** holding such acupuncture or acupuncture-like needles. The acupuncture-like needles are several centimeters long and very thin, light and springy. For example a typical acupuncture-like needle may have a handle section 20 mm long with a diameter of 1.1 mm, and a needle section of 30 mm with a diameter of 0.16 mm.

Figure 7:
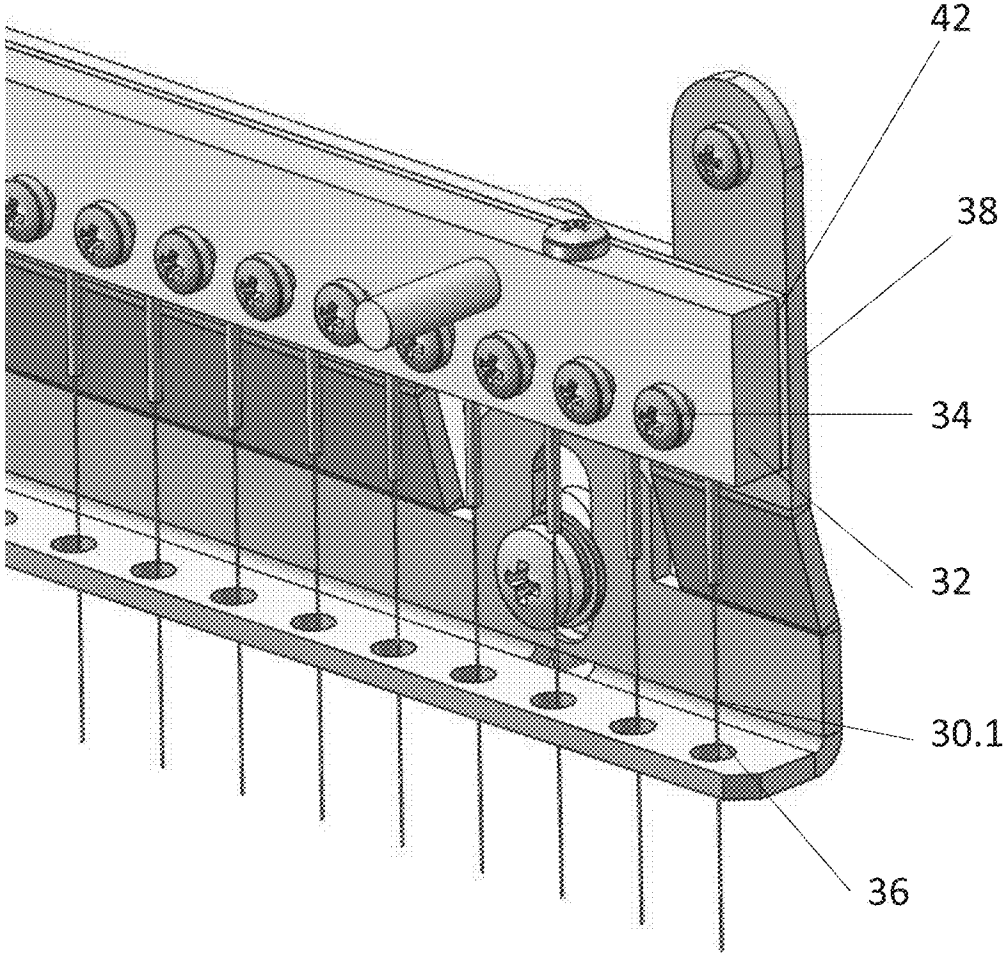
FIG. 7 is a detail of the embodiment of FIG. 6.
Figure 8:
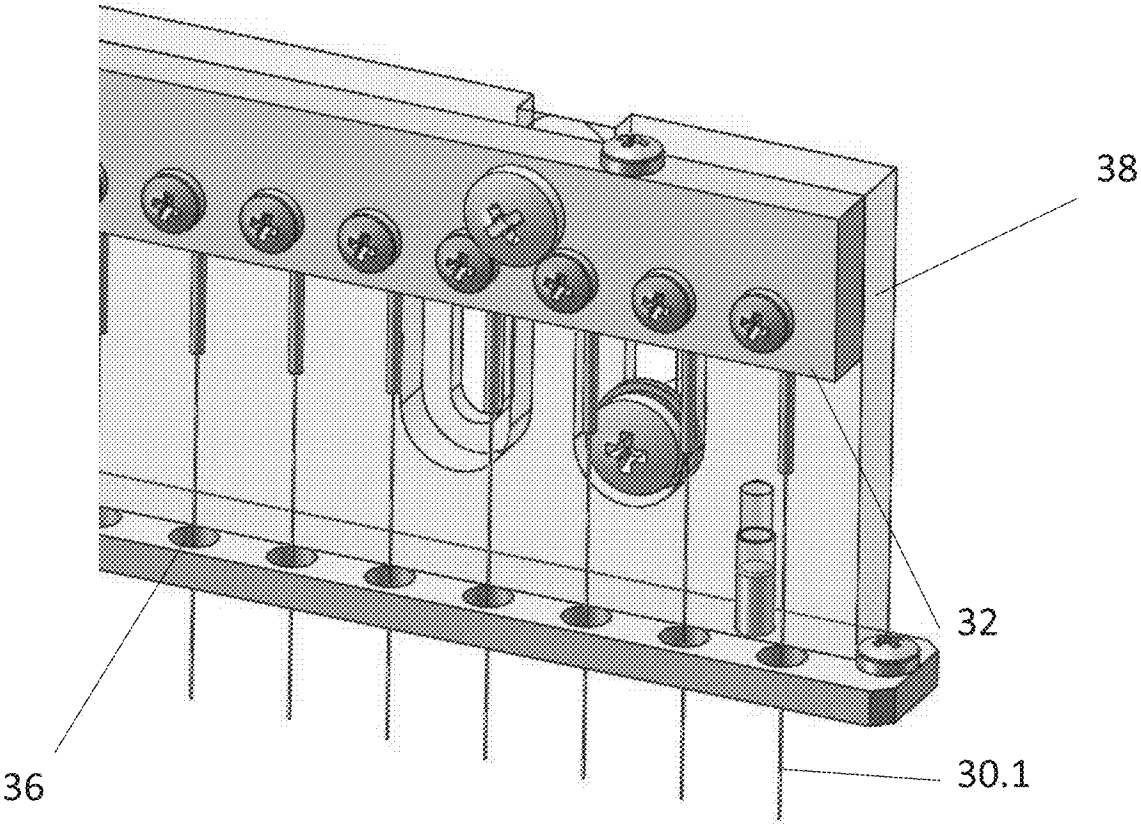
FIG. 8 is a detail of an alternative of the embodiment of FIG. 6.
Figure 9:
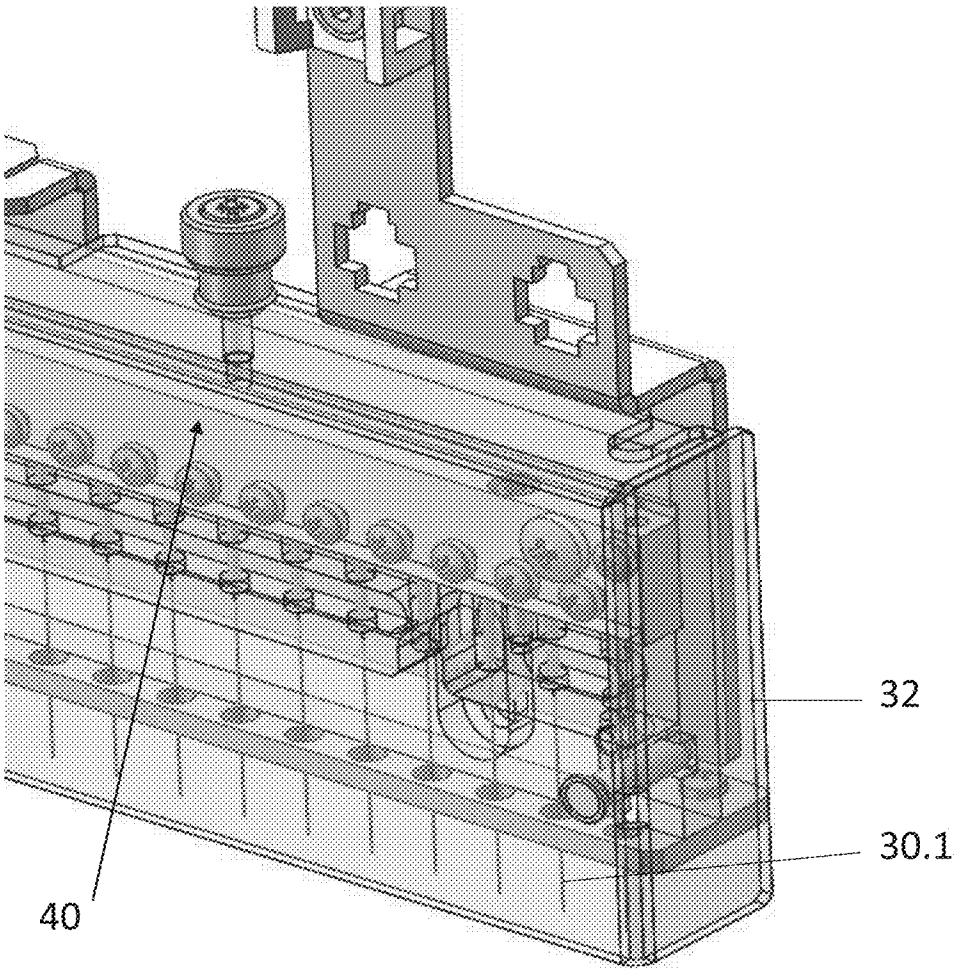
FIG. 9 is a diagram showing the embodiment of FIG. 6 with base and cover attached.
Figure 10:
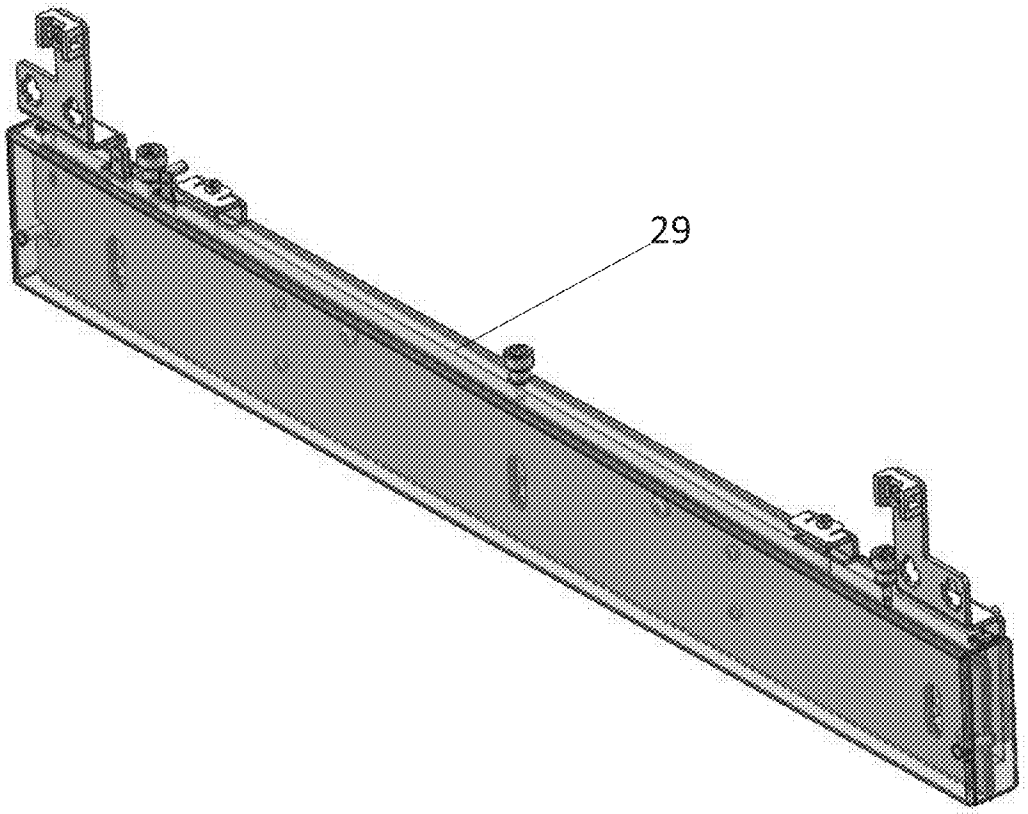
FIG. 10 illustrates a base for attaching of wrinkle detectors according to the present embodiments to the print head.

As illustrated in FIG. 7, the needles are fixed e.g. by screws 34 at an upper end and extend through the middle of holes 36 towards the clearance zone. Any fabric in the clearance zone pushes the needle and causes it to touch the walls of the hole 36, thus closing a circuit and producing a signal.

Alternatively, a ring or coiled spring may surround the needle in place of the hole and provide for closing of the circuit in the same way.

The mount 32 is held to base 38 which holds the parts together. Cover 40 (See FIG. 9) protects the structure from the front. Isolator 42 separates and electrically isolates the mount 32 from the base 38 so that the needle provides the only path that an electrical signal can take.

Both mechanical devices and electronic circuits have reaction times. Neither are instantaneous and an electromechanical system has a reaction time which is the combination of the reaction times of the electrical circuitry and the mechanical switch. The wrinkle detector may typically have a delay between deflection due to a wrinkle and providing an output signal to the fabric printer, which can be in the order of milliseconds. The reaction time needs to be short enough so that at the relative speed between the fabric and the print head, the print head has been shut off before the wrinkle arrives. As the speed may be of the order of 1000 millimeters per second, the reaction time is preferably less than two milliseconds and more preferably less than one millisecond. The processor that deals with the signals and translates them into instructions for the printer also has a reaction time. A typical processor reaction time is of the order of two milliseconds, so if two signals are close together, the second signal may need to be buffered until the processor is ready to receive the next signal.

Not all creases or wrinkles need to shut off the printer, but rather only those which occlude or block the nozzles. Therefore, as discussed, a clearance zone is defined below the nozzles in which fabric is not allowed. A high resolution printing result may need the print nozzles to be close to the fabric surface so the total space between the print head and the fabric is of the order of millimeters. The clearance zone may therefore be as small as two or even one millimeter or even less than 1 millimeter.

The printer may have separate platens, each platen carrying an item such as a tee shirt to be printed. The fabric printer may be provided with a log unit to log items on which wrinkles are detected. Thus a printing run may include a hundred shirts of which three shirts are rejected due to wrinkles. The log may allow the device to point out that the printing run is short by three shirts and offer to print three more.

Additionally or alternatively, the log may be used to find patterns in rejected printing lots so that issues can be identified and addressed.

Figure 11:
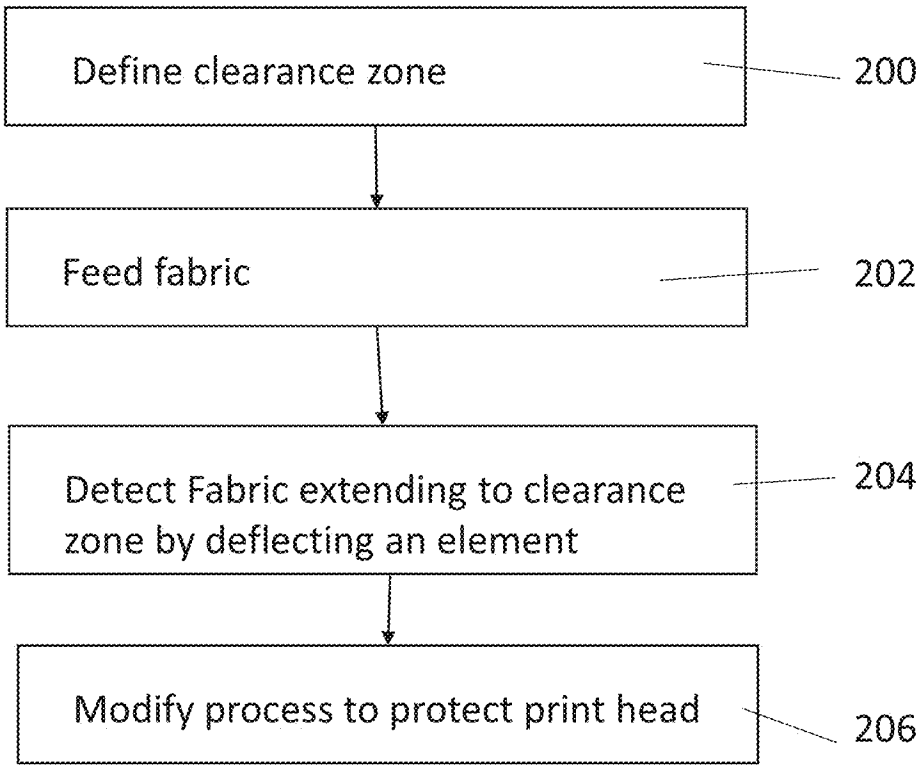
FIG. 11 is a simplified flow chart showing operation of a printer with a wrinkle detector according to the present embodiments.

Reference is now made to FIG. 11, which is a simplified flow chart showing operation of a wrinkle detector according to the present embodiments. In box 200 a clearance zone is defined below the print heads, within which the fabric is not supposed to extend. The clearance zone is typically one to two millimeters. In box 202 smoothed out fabric is fed towards the print head, typically at a speed in the order of 1000 millimeters per second. Box 204 indicates detecting wrinkles that extend into the clearance zone in the fabric approaching the print head. Detection is carried out by deflecting one or more of the deflectable elements as discussed. In box 206 signals from the detection are able to modify the printing operation. Most typically the modification consists of inhibiting printing for the current print job, often the current platen, and resuming immediately afterwards with the next platen. An alternative approach is to raise the print head so that it clears the wrinkle.

In some embodiments, detection of the wrinkle may be used to operate a cleaning cycle in the print head. A timely cleaning cycle may unblock nozzles in case the shutdown is not quick enough to prevent the wrinkle from interfering with the print head or in case there are other undetected wrinkles coinciding with the detected wrinkle. In any event a cleaning cycle is much less of a disruption to the printing process than the need to replace the print head.

Figure 12:
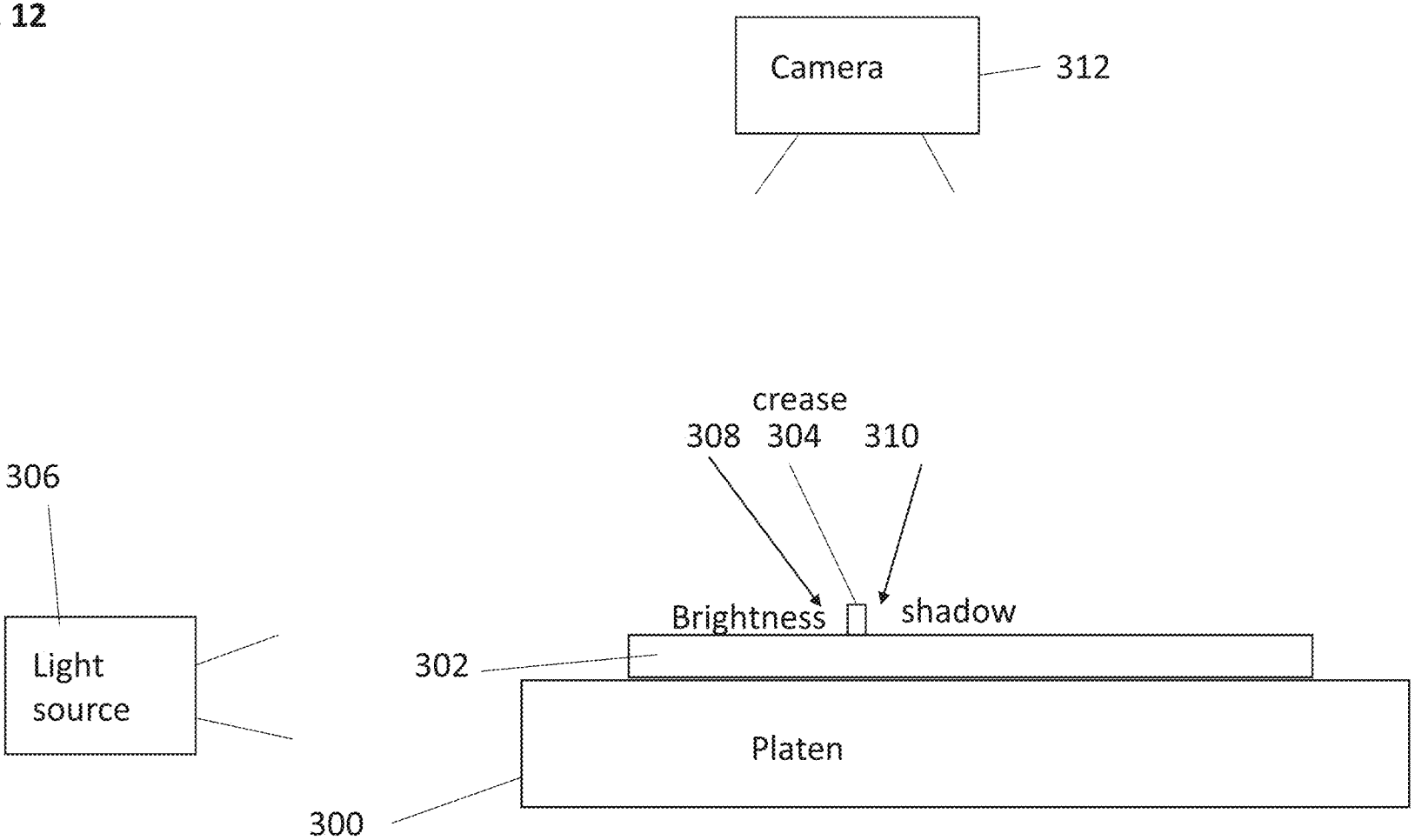
FIG. 12 is a simplified diagram illustrating use of a light source to detect wrinkles using imaging according to a further embodiment of the present invention.

Reference is now made to FIG. 12 which illustrates an alternative embodiment for detecting wrinkles. Platen 300 carries garment 302 which in turn has wrinkle 304. Bright light source 306 shines onto the garment 302 from the side and generally causes a medium level of brightness on the face of the garment. However face 308 of the wrinkle 304 faces the light source and is considerably brighter than the surrounding garment. Opposite face 310 of the garment is in shadow. Thus the side lighting of the garment causes a high contrast effect or highlighting, exaggerating the effect of the wrinkle. The high contrast is imaged by camera 312 to detect the wrinkle and protect the print head. The high contrast or highlighting is detectable even with black colored garments and suitable image processing may distinguish contrast due to wrinkles from patterns on the garment.

Figure 13:
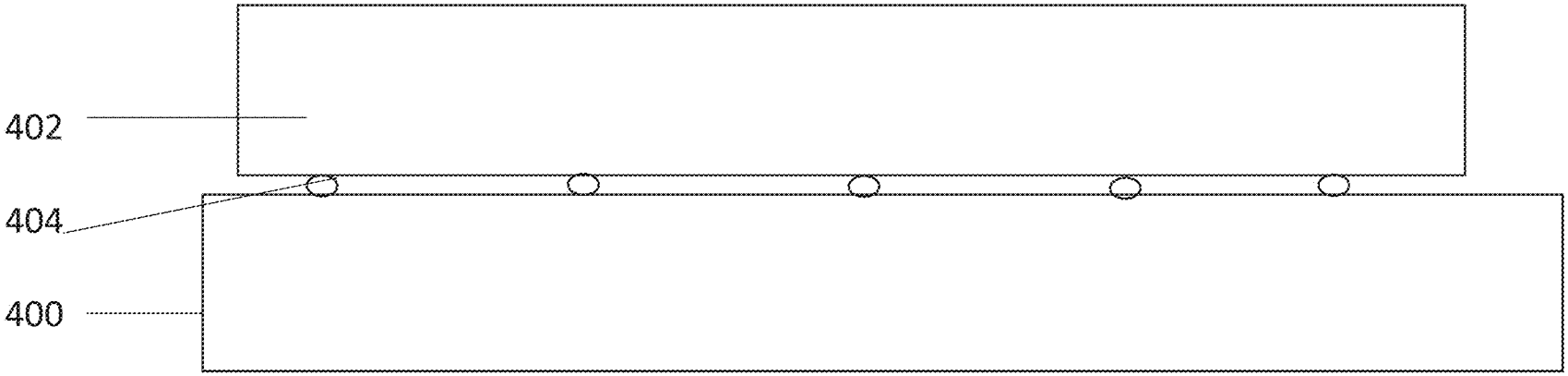
FIG. 13 is a simplified diagram illustrating a further embodiment of the present invention that uses a single flap or curtain for detecting wrinkles.

Reference is now made to FIG. 13, which illustrates a further embodiment of the present invention. In FIG. 13, a light flexible curtain 400 extends below mount 402. The flexible curtain is attached at various points to strain gauges, which are able to determine bending of the curtain and thus mechanically determine the presence of a wrinkle.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A wrinkle detector for detecting creases or wrinkles to protect a print head of a fabric printer from occlusion by protruding fabric, the wrinkle detector comprising a mounting located in advance of a print head relative to fabric approaching to be printed, the mounting comprising at least one deflectable element extending into a predetermined clearance zone between said printing head and said fabric, wherein deflection of said at least one deflectable element is used as an indicator of fabric protruding into the clearance zone, said deflectable element being linearly deflected to cause electrical switching and further configured to close a powered circuit or to modulate a resistance or a reactance of a powered circuit upon said being linearly deflected.

2. The wrinkle detector of claim 1, wherein said deflectable element is sufficiently light to be deflected by a light fabric.

3. The wrinkle detector of claim 1, wherein said deflectable element comprises a flap.

4. The wrinkle detector of claim 3, wherein said flap is configured to close said circuit upon said being linearly deflected.

5. The wrinkle detector of claim 3, wherein said flap is configured to modulate said resistance or said reactance upon said being linearly deflected.

6. The wrinkle detector of claim 1, wherein said deflectable element comprises a pin.

7. The wrinkle detector of claim 6, wherein said pin is an acupuncture-like needle.

8. The wrinkle detector of claim 6, wherein said pin is surrounded by a conductive ring and wherein deflection of said pin causes said pin and said ring to touch.

9. The wrinkle detector of claim 1, configured to stop printing of a current printing job on detection of a wrinkle.

10. The wrinkle detector according to claim 1, having a detection delay between occurrence of said deflection due to a wrinkle and providing an output signal to said fabric printer, wherein said delay does not exceed two milliseconds.

11. The wrinkle detector according to claim 1, wherein said clearance zone does not exceed two millimeters.

12. The wrinkle detector of claim 1 wherein said clearance zone does not exceed one millimeter.

13. The wrinkle detector according to claim 1, comprising a plurality of deflectable elements forming a comb structure wherein teeth of said comb extend into said clearance range in advance of said print head as said print head moves relative to fabric to be printed.

14. The wrinkle detector of claim 1, being attached to a fabric printer, the fabric printer comprising a print head for printing on fabrics.

15. The wrinkle detector of claim 14, wherein the fabric printer comprises a plurality of platens, each platen carrying an item to be printed, the fabric printer configured with a log unit to log items on which wrinkles are detected.

16. A method of protected printing of fabrics using a printhead, the method comprising:

defining a clearance zone below said print head;

feeding smoothed out fabric towards said print head for printing;

detecting wrinkles that extend into said clearance zone in fabric approaching said print head, said detecting comprising linearly deflecting a deflectable element said linearly deflecting causing closing of a powered circuit or modulating of a resistance or a reactance in a powered circuit; and using said detecting to modify a printing operation.

17. The method of claim 16, wherein said deflecting causes electrical switching.

18. The method of claim 16, wherein said modification comprises stopping printing of a current printing job.

19. The method according to claim 16, having a detection delay between occurrence of said deflection due to a wrinkle and providing an output signal for said modification, wherein said delay does not exceed two milliseconds.

20. The method according to claim 16, wherein said clearance zone does not exceed two millimeters.

21. The method according to claim 16, wherein said clearance zone does not exceed one millimeter.

22. The method according to claim 16, comprising providing a plurality of print jobs and wherein said modification comprises inhibiting printing on any one of said plurality of print jobs on which a wrinkle is detected while continuing to print each other print job.

* * * * *